United States Patent [19]

O'Hanlan

[11] Patent Number: 4,468,824

[45] Date of Patent: Sep. 4, 1984

[54] WATER FILLED PRESSURE RELIEF DEVICE WITH RECTANGULAR APERTURE

[76] Inventor: J. Treacy O'Hanlan, 220 Rosser Ave., Waynesboro, Va. 22980

[21] Appl. No.: 425,781

[22] Filed: Sep. 28, 1982

[51] Int. Cl.[3] ..... A47C 27/08; A47G 9/00

[52] U.S. Cl. ..... 5/451; 5/441

[58] Field of Search ..... 5/451, 441, 450, 449, 5/466, 438, 452, 422; 73/40.7; 297/DIG. 3; 116/DIG. 41

[56] References Cited

U.S. PATENT DOCUMENTS

| | | | |
|---|---|---|---|
| 682,871 | 9/1901 | Hogan et al. . | |
| 1,306,787 | 6/1919 | Stevenson | 5/451 |
| 1,595,698 | 7/1925 | Wilson . | |
| 1,693,737 | 12/1928 | Weldon | 73/40.7 |
| 1,746,953 | 2/1930 | McCollum | 5/449 |
| 1,886,637 | 6/1931 | Buckley . | |
| 2,056,767 | 10/1935 | Blath | 128/132 |
| 2,201,424 | 9/1939 | Berger | 128/399 |
| 2,878,392 | 3/1959 | Polito | 73/40.7 |
| 2,933,738 | 4/1960 | Whelan . | |
| 3,045,257 | 7/1962 | Knapp | 5/449 |
| 3,158,878 | 8/1963 | Pernell . | |
| 3,462,775 | 8/1969 | Markwitz et al. . | |
| 3,602,928 | 9/1971 | Helzer | 5/441 |
| 3,611,455 | 10/1971 | Gottfried . | |
| 3,900,910 | 8/1975 | Nakata . | |
| 3,958,286 | 5/1976 | Rodinsky | 5/451 |
| 4,141,770 | 2/1979 | Mollura | 5/451 |
| 4,250,740 | 2/1981 | Wagner et al. | 73/40.7 |
| 4,338,692 | 7/1982 | Santo | 5/451 |
| 4,370,769 | 2/1983 | Herzig et al. | 5/452 |
| 4,375,112 | 3/1983 | Leonhart | 5/436 |
| 4,382,306 | 5/1983 | Lickert | 5/441 |

FOREIGN PATENT DOCUMENTS

| | | | |
|---|---|---|---|
| 2410624 | 9/1975 | Fed. Rep. of Germany | 5/449 |
| 1384775 | 2/1975 | United Kingdom | 5/451 |

*Primary Examiner*—Alexander Grosz

*Attorney, Agent, or Firm*—Sughrue, Mion Zinn Macpeak & Seas

[57] ABSTRACT

A pressure relief device for bed-ridden patients is comprised of a hollow annular cushion having a valve to permit filling of the cushion with water, laterally extending tabs to facilitate positioning of the device, and an anti-bacterial agent and a dye agent located within the hollow cushion.

1 Claim, 3 Drawing Figures

WATER FILLED PRESSURE RELIEF DEVICE WITH RECTANGULAR APERTURE

BACKGROUND OF THE INVENTION

The present invention is directed to a pliable water-filled support device usable by bed-ridden patients for use with selected pressure points to prevent the occurence of bed sores.

When a person is confined to bed for an extended period of time it is not uncommon for ulcers to develop at various pressure points such as the end of the spine or the hip from constant rubbing contact with the bedding. In order to prevent such sores or to relieve the pain associated with such sores, people have in the past resorted to the use of various types of pillows or cushions in order to relieve the pressure at such pressure points. The use of ordinary pillows filled with down or other synthetic type materials such as synthetic fibers, sponge rubber, foamed plastic materials or the like is common. However, such filling material generally tends to be compacted after a while so that the relief is only temporary. Air filled cushions having various configurations have also been used in the past, but generally tend to be non-conforming and while relieving the pressure at one point will create additional pressure at other points which could lead to an ulcerated skin condition.

SUMMARY OF THE INVENTION

The present invention provides a new and improved pressure relief device designed especially for use with bed-ridden patients which overcomes all of the drawbacks of the aforementioned prior art devices.

The present invention provides a new and improved pressure relief device which is comprised of a hollow plastic annular cushion having a substantially rectilinear configuration. The cushion is provided with one-way valve means for filling the cushion with water and integral tabs or handgrips to facilitate the shifting of the cushion to the optimum position with respect to a patient's anatomy. The hollow plastic cushion is provided with an anti-bacterial agent and a tracer dye to inhibit the growth of bacterial and to provide a leakage warning respectively.

The foregoing and other objects, features and advantages of the invention will be apparent from the following description of the preferred embodiment of the invention as illustrated in the accompanying drawings.

DETAILED DESCRIPTION OF THE INVENTION

Figure 1:
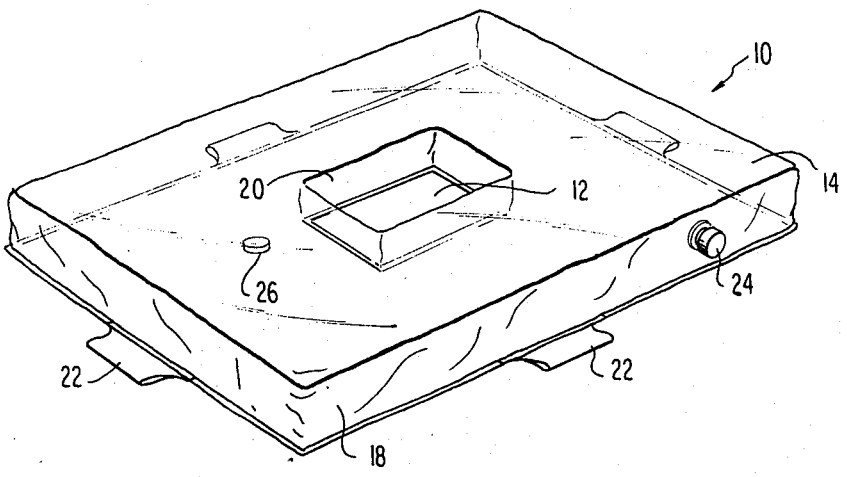
FIG. 1 is a perspective view of the pressure adaptive device according to the present invention in the filled condition.
Figure 2:
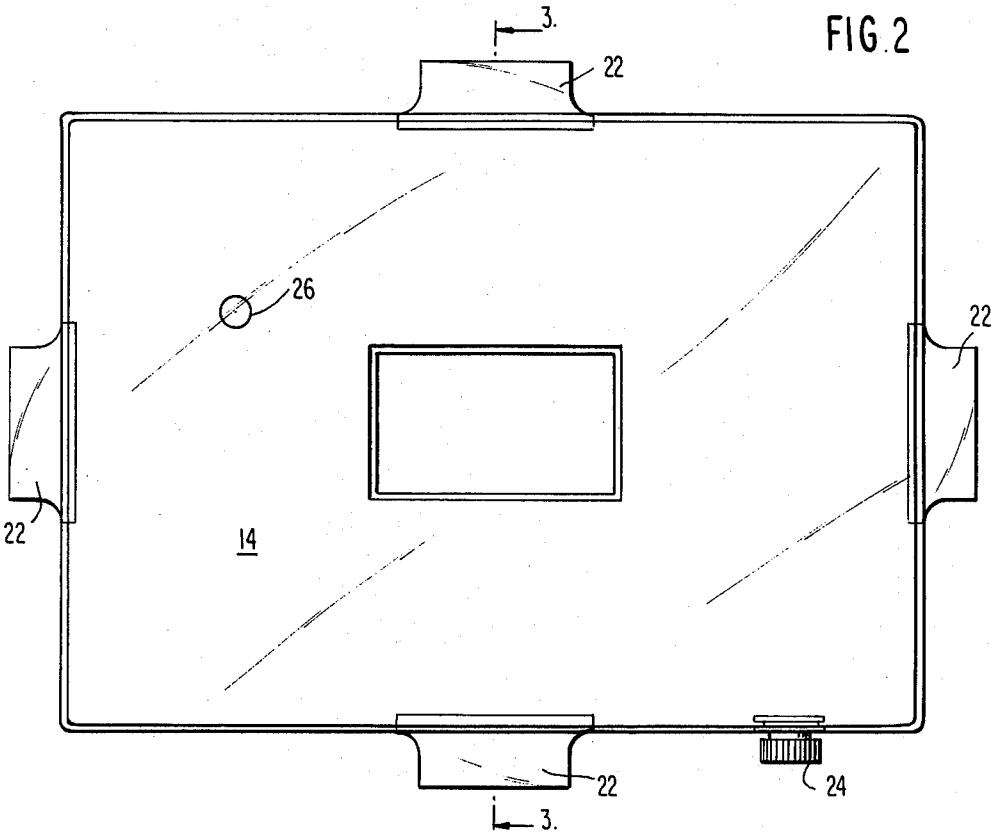
FIG. 2 is a top plan view of the device as shown in FIG. 1.
Figure 3:
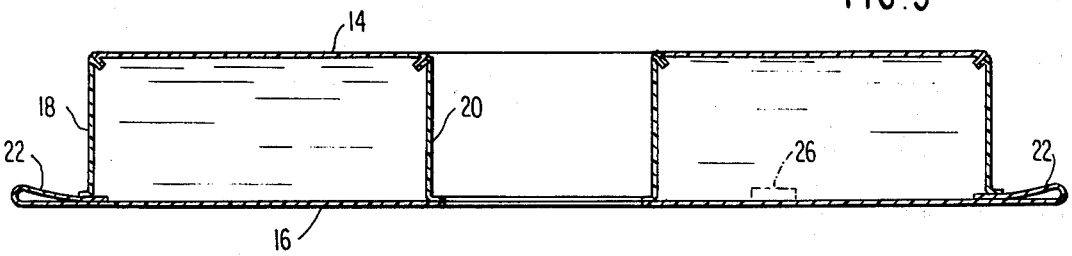
FIG. 3 is a sectional view of the device taken along 3—3 of FIG. 2.

The pressure relief device 10 as shown in the drawings is comprised of an annular ring of plastic material having a substantially parallelepiped external configuration as well as a substantially rectilinear aperture 12 in the center thereof. While the pressure relief device may be fabricated from any number of panels of flexible plastic material secured together by any suitable means to define the hollow, waterproof ring, the device as shown in the drawings is comprised of an upper piece 14, a lower piece 16, an outer peripheral strip 18 and an inner peripheral strip 20 heat sealed together along the edges thereof to define the hollow rectilinear annular ring. The bottom sheet 16 is provided with a lateral extension 22 on each side thereof at approximately the midpoint thereof. The extensions 22 are folded back on themselves and heat sealed between the bottom sheet 16 and the outer peripheral strip 18 to define gripping tabs to assist in the positioning of the device under a patient to locate the device in the optimal position relative to the patient's anatomy. The filling valve 24 of any suitable construction is secured to the outer peripheral strip 18 to enable the interior of the hollow plastic ring to be filled with water. The valve may be of the one-way type which only allows the water to enter the device or may consist of a simple hollow tube having external threads for the reception of a sealing cap which is adapted to provide a water tight connection. At the time the device is assembled a tablet 26 may be inserted therein or may be subsequently added if the valve 24 is of a configuration which will permit the insertion of the tablet. The tablet may include a water soluable anti-bacterial agent as well as a dye or two separate tablets may be provided, one of which is an anti-bacterial type and the other of which contains a dye. The presence of the anti-bacterial agent prevents the growth of bacteria which could cause a problem should the bag ever spring a leak when in use under a patient. Likewise, the dye will provide an early warning system for any minor leaks in the bag so that the bag can be discarded before a major rupture occurs.

The plastic material may be of any suitable type as long as it is sufficiently soft and flexible and it is relatively durable. It is preferable to have the plastic material constructed of opaque or translucent material for aesthetic reasons. While any type of valve may be used, it is preferable to utilize a one-way valve so that the device cannot be emptied and reused. The pressure relief device is designed to be a personal device to prevent the spread of infection. Although the pressure relief device is preferably sold with the anti-bacterial agent and dye sealed therein, the device is preferably sold in the empty condition to reduce shipping costs and to facilitate storage.

While the hip and the end of the spine are the two most common locations for the formation of skin ulcers on a bed-ridden patient, it is obvious that the pressure relief device can be utilized in conjunction with numerous other parts of the anatomy depending upon the specific problems involved. In general, the device is located under the patient with the pressure point such as the hip or end of the spine located in the central opening 12. The water filled annular device will readily conform to the contours of the person's anatomy surrounding the pressure point to gently support the body of the patient in a non-abrasive manner.

While the invention has been particularly shown and described with reference to a preferred embodiment thereof, it will be understood by those in the art that various changes in form and details may be made therein without departing from the spirit and scope of the invention.

What is claimed is:

1. A pressure relief device comprising a parallelepiped hollow cushion of flexible plastic material having a parallelepiped central aperture therethrough, valve means extending through said device for filling said device for water, gripping means integrally formed with said device to facilitate shifting of the device relative to a patient, and means located in said device to prevent the growth of bacteria and to provide a tracer dye, said cushion being comprised of an upper rectangular sheet having a rectangular aperture in the center thereof, a lower rectangular sheet having a rectangular aperture in the center thereof, an outer peripheral strip sealed between the outer edges of said upper sheet and said lower sheet to define an outer side wall and an inner peripheral strip connected between the edges of said apertures in said upper and lower sheets to define an inner side wall wherein the edges of said strips and the edges of said upper sheet are folded inwardly in overlapping relation to define an outwardly smooth strong waterproof seal and the edges of said strips are sealed to the bottom sheet in flat overlying relation thereto whereby the cushion, when filled with water, will tend to maintain the edges of the upper sheet in spaced relation to the edges of the lower sheet upon the application of pressure to the upper sheet between the outer edges and the edges of the aperture to maintain the bony protuberances of a patient which are aligned with the aperture in spaced relation to whatever surface the cushion is placed upon, said gripping means being defined by a plurality of lateral extensions provided on said lower sheet in folded back relation and sealed between the lower edges of said outer peripheral strip and said lower sheet, providing at least one loop on each side of said cushion, thus providing gripping means for positioning said device relative to the bony protuberances of a patient.

* * * * *